US006255567B1

(12) United States Patent
Minakuchi

(10) Patent No.: US 6,255,567 B1
(45) Date of Patent: Jul. 3, 2001

(54) STRINGED MUSICAL INSTRUMENT WITH COMPOSITE BODY PARTIALLY FORMED OF METAL OR SYNTHETIC RESIN

(75) Inventor: Kiyoshi Minakuchi, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/484,312

(22) Filed: Jan. 18, 2000

(30) Foreign Application Priority Data

Jan. 19, 1999 (JP) ..... 11-010553

(51) Int. Cl.[7] ..... G10D 3/00
(52) U.S. Cl. ..... 84/291; 84/452 R
(58) Field of Search ..... 84/452 R, 267, 84/290–292

(56) References Cited

U.S. PATENT DOCUMENTS 4,290,336 * 9/1981 Peavey ..... 84/291
4,829,870 * 5/1989 Ralston ..... 84/291
5,333,527 * 8/1994 Janes et al. ..... 84/291
5,406,874 * 4/1995 Witchel ..... 84/291
5,889,221 * 3/1999 Dejima ..... 84/291
6,114,616 9/2000 Naylor .

FOREIGN PATENT DOCUMENTS 55-2460 1/1980 (JP) .
55-36872 8/1980 (JP) .

* cited by examiner

*Primary Examiner*—Jeffrey Donels
(74) *Attorney, Agent, or Firm*—Ostrolenk, Faber, Gerb & Soffen, LLP

(57) ABSTRACT

An electric guitar has a body, a neck projecting from the body, strings stretched over the body and the neck and a pick-up attached to the body under the strings for producing an electric signal representative of vibrations of the strings, wherein the body has a body frame of metal/alloy or synthetic resin, a center block formed of metal/alloy/synthetic resin or wood and fixedly accommodated in the inner space of the body frame and deck plates adhered to both surfaces of the body frame so that a manufacturer produces the body through a simple process.

14 Claims, 4 Drawing Sheets

STRINGED MUSICAL INSTRUMENT WITH COMPOSITE BODY PARTIALLY FORMED OF METAL OR SYNTHETIC RESIN

FIELD OF THE INVENTION

This invention relates to a stringed musical instrument and, more particularly, to a body structure of a stringed musical instrument such as, for example, an electric guitar.

DESCRIPTION OF THE RELATED ART

The electric guitar comprises a body, a neck projecting from the body and strings stretched over the body and the neck. The body is broken down into a solid structure and a semi-acoustic structure. A typical example of the solidtype body is disclosed in Japanese Utility Model Publication of Examined Application No. 55-36872. The solid-type body disclosed therein is formed of wood, and a wooden block is shaped into the complicated configuration. The body is perfectly solid, or a hollow space is formed in the body.

On the other hand, a typical example of the semi-acoustic type body is disclosed in Japanese Utility Model Publication of Examined Application No. 55-2460. Several wooden deck plates and panels are assembled into the semi-acoustic type body. The wooded deck plates/ panels are a front deck plate, a back deck plate, side plates and a center block, and defines a resonator inside of the body. The front deck plate, the back deck plate and the side plates are, by way of example, formed of silver fir or spruce. On the other hand, the center block is usually formed of maple.

FIG. 1 illustrates a typical example of the electric guitar. The prior art electric guitar has a solid body 1, a neck 2, strings 3, a bridge 4, pick-ups 5, a tail piece 6, dials 7 and a power switch 8. The solid body 1 is formed of wood, and has a unique configuration. The solid body 1 has a front surface, a back surface and a side surface. Although the neck 2 is separated from the solid body 1 in FIG. 1, the neck 2 is fixed to the solid body 1, and projects from the side surface of the solid body 1. The tail piece 6 is attached to the front surface, and is located on the opposite side to the neck 2. The bridge 4 and the pick-ups 5 are also attached to the front surface, and are positioned between the neck 2 and the tail piece 6. The strings 3 are stretched between pegs at the leading end of the neck 2 and the tail piece 6, and the bridge 4 and the pick-ups 5 are under the strings 3. The bridge 4 gives appropriate tension to the strings 3. The pick-ups 5 detect vibrations of the strings 3, and convert the vibrations to electric signals. Though not shown in FIG. 1, the pick-ups 5 are connected to a suitable amplifier, which makes a speaker system generate electric sounds. When the power switch 8 turns on, the dials 7 and the pick-ups 5 are energized. A player manipulates the dials 7 in order to regulate the volume, the tone color etc.

The solid body 1 is formed as follows. Prior to a machining, an aging is required for a wooden block to be machined. The wooden block is 40 to 50 millimeters thick. The wooden block is shaped into the unique configuration by using wood working machines. The wood work is polished, and, thereafter, is painted. A rough coating is carried out for the wood work, and a primer coating, a polishing, an intermediate coating, a polishing, a finish coating and a polishing follows. Thus, the polishing and the coating are repeated, and the prior art solid body 1 is obtained.

After completion of the solid body 1, the bridge 4, pick-ups 5, the tail piece 6, the dials 7 and the power switch 8 are attached to the solid body 1, and the neck 2 is connected to the solid body 1. Finally, the strings 3 are stretched between the pegs and the tail piece 6.

FIG. 2 shows a semi-acoustic body of another prior art electric guitar. The semi-acoustic body has a built-up structure. A front deck plate 11, a back deck plate 12 and a side plate 13 form a hollow space 14, and a center block 15 is provided between the front deck plate 11 and the back deck plate 12. Strings 16 are stretched over the front deck plate 11.

The prior art semi-acoustic body is manufactured through a process similar to that of the prior art solid body. The aging step, machining steps, an assembling step, the painting steps and the polishing steps are incorporated in the process for fabricating the semi-acoustic body.

As described hereinbefore, the prior art bodies, i.e., both solid and semi-acoustic bodies are formed of wood. However, the manufacturer suffers from high production cost of the wooden body. This is because of the fact that the wood work passes the various steps during the manufacturing. The aging step, the machining steps, the polishing steps and the coating steps form the manufacturing process, and the manufacturer consumes a large amount of time and labor for the prior art body. Especially, the coating steps and the polishing steps are indispensable to the wood work, and are time-consuming. In fact, the manufacturer consumes fifty percent of the time required for the manufacturing. Thus, the prior art wooden bodies are low in productivity, and the manufacturer suffers from the high production cost. This is the first problem inherent in the prior art bodies.

The second problem is the exhaust of the forest resources due to the deforestation. It is getting more difficult to obtain the wood.

The third problem is the machinability of the wood. The wood is brittle, and the brittleness set a limit on the configuration of the wooden body.

SUMMARY OF THE INVENTION

It is therefore an important object of the present invention to provide a stringed musical instrument, a body of which is low in production cost, easy to obtain materials and high in machinability.

To accomplish the object, the present invention proposes to use a body frame formed of metal, alloy or synthetic resin.

In accordance with one aspect of the present invention, there is provided a stringed musical instrument comprising a body including a body frame formed of a first material selected from the group consisting of metal, alloy and synthetic resin and having an inner space open to a front surface and a back surface thereof, a center block formed of a second material and accommodated in the inner space and deck plates formed of a third material and fixed to the front surface and the back surface so as to confine the center block in the inner space, and at least one string stretched over the front deck plate.

BRIEF DESCRIPTION OF THE DRAWINGS

The features and advantages of the stringed musical instrument will be more clearly understood from the following description taken in conjunction with the accompanying drawings in which.

DESCRIPTION OF THE PREFERRED EMBODIMENT

Figure 3:
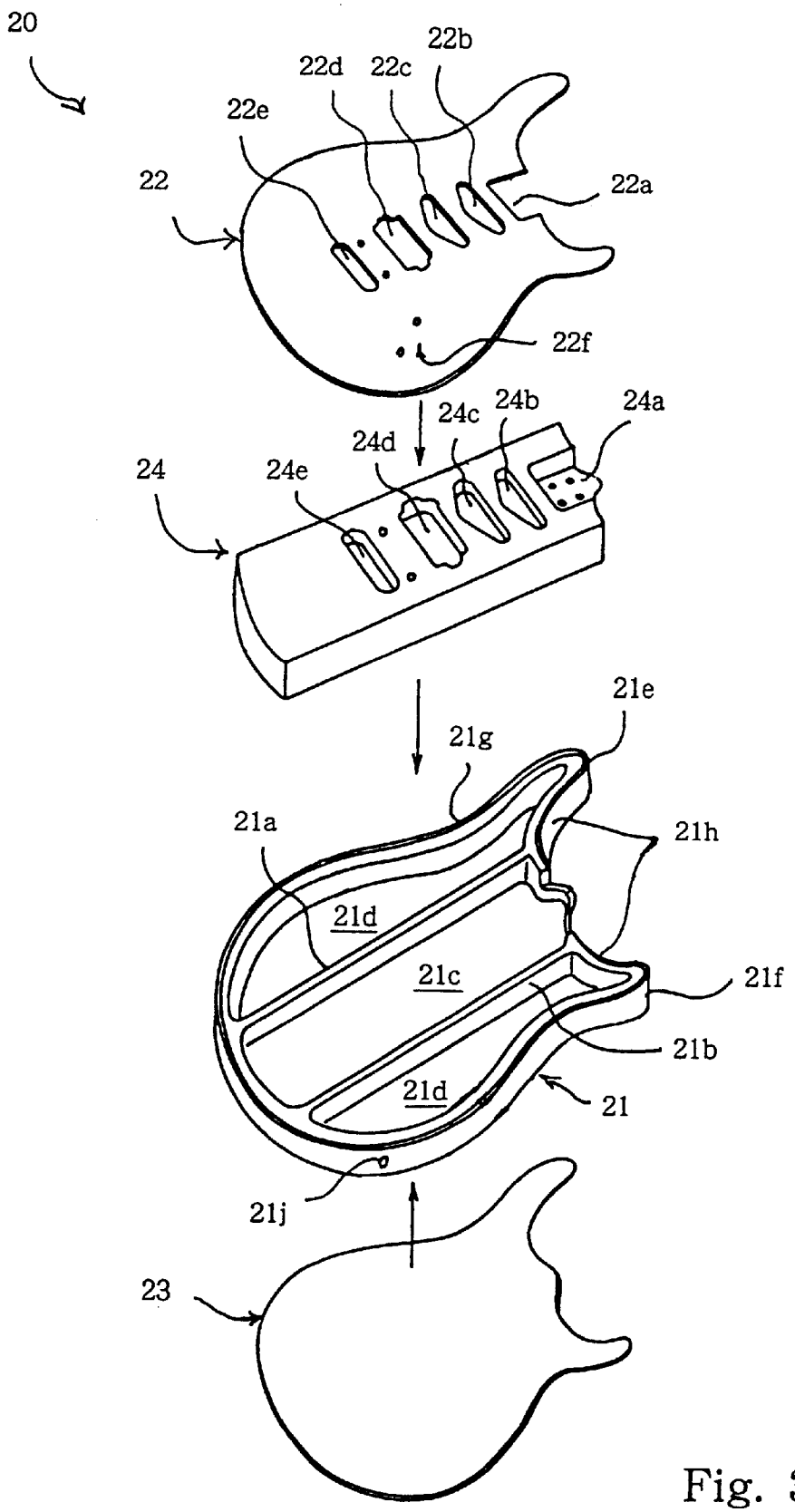
FIG. 3 is an exploded perspective view showing a body of an electric guitar according to the present invention.
Figure 4:
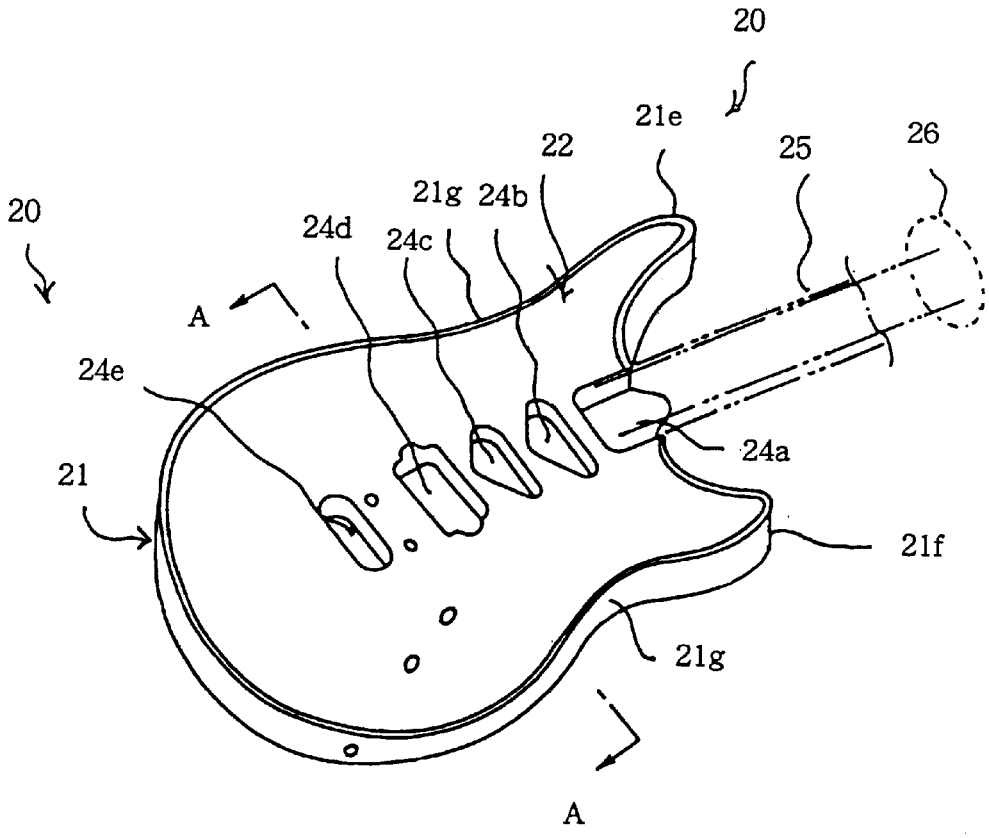
FIG. 4 is a perspective view showing the body after the assemblage.
Figure 5:
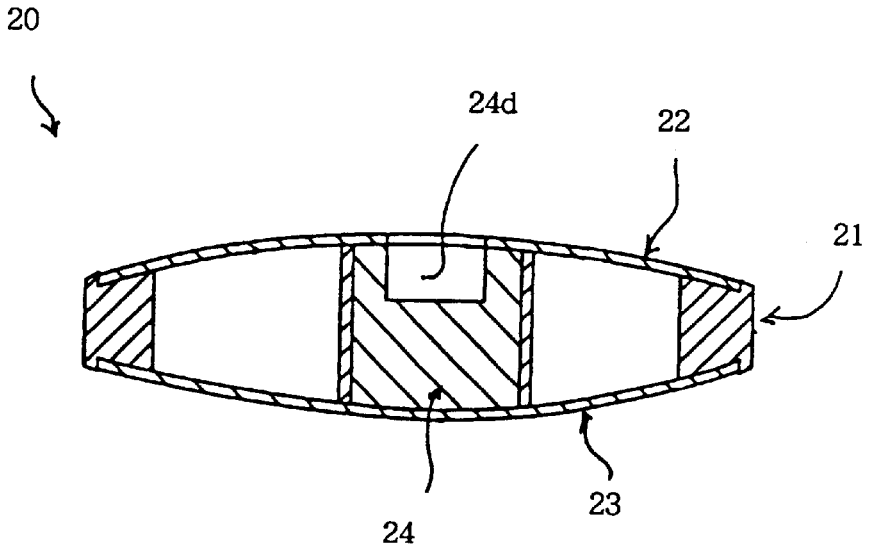
FIG. 5 is a cross sectional view taken along line A—A of FIG. 4 and showing the structure of the body.

Referring now to the drawings, and in particular to FIGS. 3, 4 and 5, a body forming a part of an electric guitar embodying the present invention is shown and generally indicated at 20. The body 20 comprises a body frame 21, a front deck plate 22, a back deck plate 23 and a center block 24. The body frame 21 has a contour identical with those of the front/back deck plates 22/23. The center block 24 is accommodated inside the body frame 21, and the center block 24 and the body frame 21 are sandwiched between the front deck plate 22 and the back deck plate 23.

The body frame 21 is formed of metal, alloy such as, for example, aluminum alloy or magnesium alloy or synthetic resin, and has two partition walls 21*a*/21*b*. Conductive synthetic resin may be used for the body frame 21. The conductive synthetic resin is effective against noise. The two partition walls 21*a*/21*b* divides the inner space into three sections 21*c*/21*d*. The section 21*c* is assigned to the center block 24, and has a contour corresponding to that of the center block 24. For this reason, the center block 24 is snugly received in the section 21*c*, and is fixed between the front deck plate 22 and the back deck plate 23. The other sections 21*d* are empty, and make the body frame 21 light. Electric components such as a power switch and dials are attached to the front deck plate 22, and partially project into the sections 21*d*. The power switch and the dials are similar to the power switch 8 and the dials 7, and are not shown in the figures. The electric components are connected through a cable (not shown) to a socket (not shown), and the socket is open to a hole 21*j* formed in the rear portion of the body frame 21. A plug is insertable through the hole 21*j* to the socket, and the electric components are connected through the plug-and-socket connector and a cable to an amplifier (not shown).

The rear portion of the body frame 21 is rounded, and horn-like projections 21*e*/21*f* are formed on the opposite side. The horn-like projection 2*e* is longer than the other horn-like projection 21*f*, and the horn-like projections 21*e*/21*f* are connected to each other so as to form a gently curved surface 21*h*. The body frame 21 is constricted between the rear end portion and the horn-like projections 21*e*/21*f*, and the constricted portion 21*g* is gently curved.

The center block 24 is formed of synthetic resin or wood. If the metal/alloy and/or the synthetic resin is used for the body frame 21 and the center block 24, the manufacturer reduces the amount of wood to be required, and a fabrication process is made simple, because neither coating nor polishing step is incorporated in a fabrication process.

Figure 1:
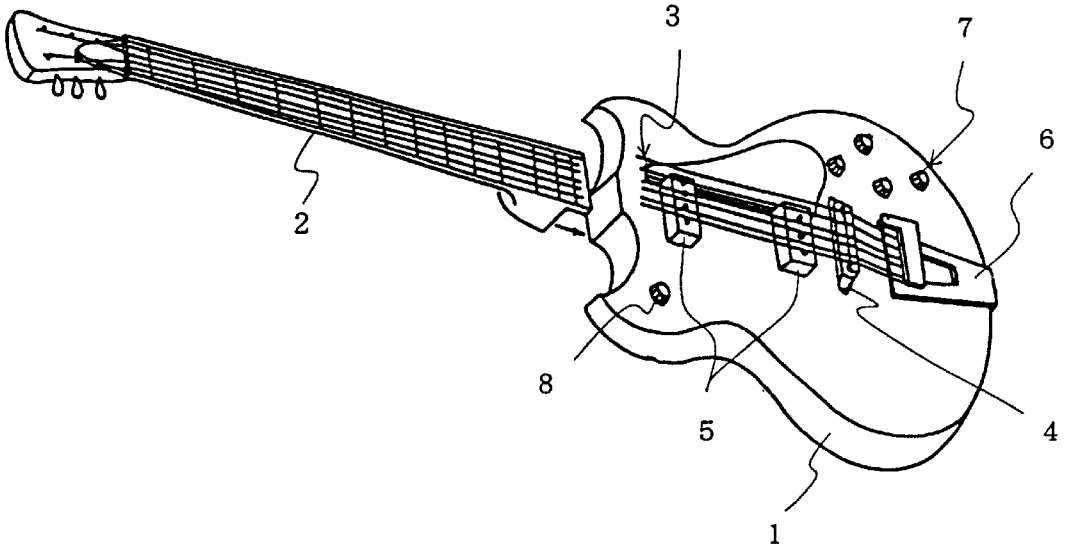
Fig. 1 PRIOR ART
FIG. 1 is a perspective view showing the prior art electric guitar, the solid body of which is separated from the neck.
Figure 2:
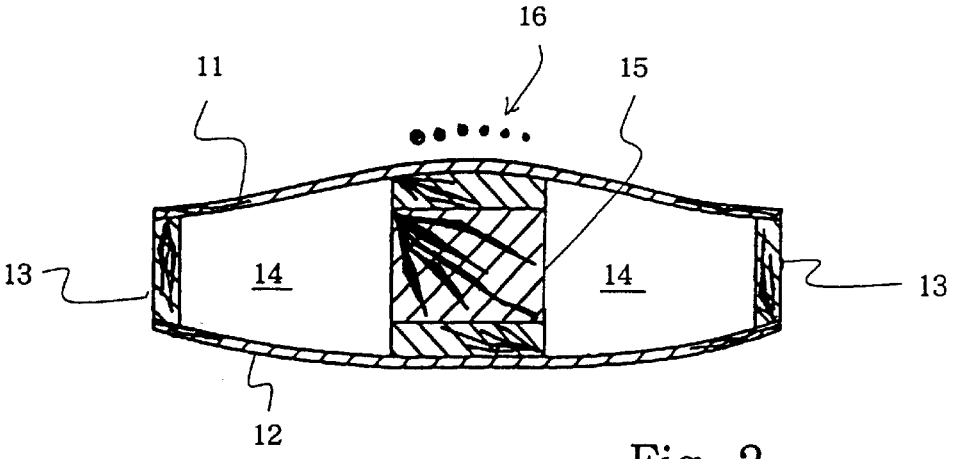
Fig. 2 PRIOR ART
FIG. 2 is a cross sectional view showing the structure of the semi-acoustic body forming the part of the prior art electric guitar.

The center block 24 has a depression 24*a* and recesses 24*b*/24*c*/24*d*/24*e*. The boss portion of a neck 25 is snugly received in the depression 24*a*, and is fixed to the center block 24 by means of bolts. Strings 26 are stretched over the neck 25 and the body 20, and are anchored at pegs and a tail piece as similar to the prior art electric guitar. The recesses 24*b*/24*c*/24*d* are assigned to pick-ups corresponding to the pick-ups 5 (see FIG. 1), and the recess 24*e* is assigned to a bridge corresponding to the bridge 4. The pick-ups and the bridge are respectively accommodated in the recesses 24*b*/24*c*/24*d* and the recess 24*e*, and project over the front deck plate 22. The center block 24 is gradually decreased in thickness from the center portion toward the side portions (see FIG. 5).

If the manufacturer selects alloy such as the aluminum alloy or the magnesium alloy for the body frame 21 and the center block 24, the body frame 21 and the center block 24 may be shaped into the configurations by using a die-casting technique. On the other hand, if the synthetic resin is selected, the body frame 21 and/or the center block 24 may be formed through an injection molding. Thermoplastic resin and thermosetting resin are available for the body frame 21 and/or the center block 24. It is desirable to use a conductive synthetic resin such as, for example, carbon-containing synthetic resin or copper- containing synthetic resin enhances anti-noise property of the body 20. The carbon particles or the copper particles may be dispersed in polyurethane or polyester. The synthetic resin is easily colored, and any painting step is required. Thus, the usage of synthetic resin makes the fabrication process simple.

The front deck plate 22 and the back deck plate 23 have the contour identical with that of the body frame 21 as described hereinbefore. Although any hole is not formed in the back deck plate 23, the front deck plate 22 is partially cut away so as to form a cut-away 22*a*, and through-holes 22*b*/22*c*/22*d*/22*e* are formed in the front deck plate 22. An inner periphery defining the cut-away 22*a* is identical with the inner periphery of the center block 24 defining the depression 24*a*, and, for this reason, the depression 24*a* is over-lapped with the cut-away 22*a*. The inner peripheries of the front deck plate 22 defining the through-holes 22*b*/22*c*/22*d*/22*e* are also identical with the inner peripheries of the center block 24 defining the recesses 24*b*/24*c*/24*d*/24*e*, respectively, and the recesses 24*b*/24*c*/24*d*/24*e* are respectively over-lapped with the through-holes 22*b*/22*c*/22*d*/22*e*. Small circular holes 22*f* are further formed in the front deck plate 22. Manipulating levers pass through the small circular holes 22*f*, and knobs are respectively attached to the leading ends of the manipulating levers.

The front deck plate 22 and the back deck plate 23 are formed of wood, metal, alloy, synthetic resin or composite material such as, for example, carbon-graphite. If the manufacturer selects the wood, several kinds of veneer board are available for the front deck plate 22 and the back deck plate 23. The veneer board may be formed from pieces of horse chestnut or pieces of sycamore. Aluminum alloy is an example of the alloy.

If the manufacturer selects the metal, the alloy or the synthetic resin, metal/alloy/synthetic resin plates are shaped into the front deck plate 22 and the back deck plate 23 by using a punching machine, and any painting step is not required. As a result, the fabrication process is made simple.

Figure 6:
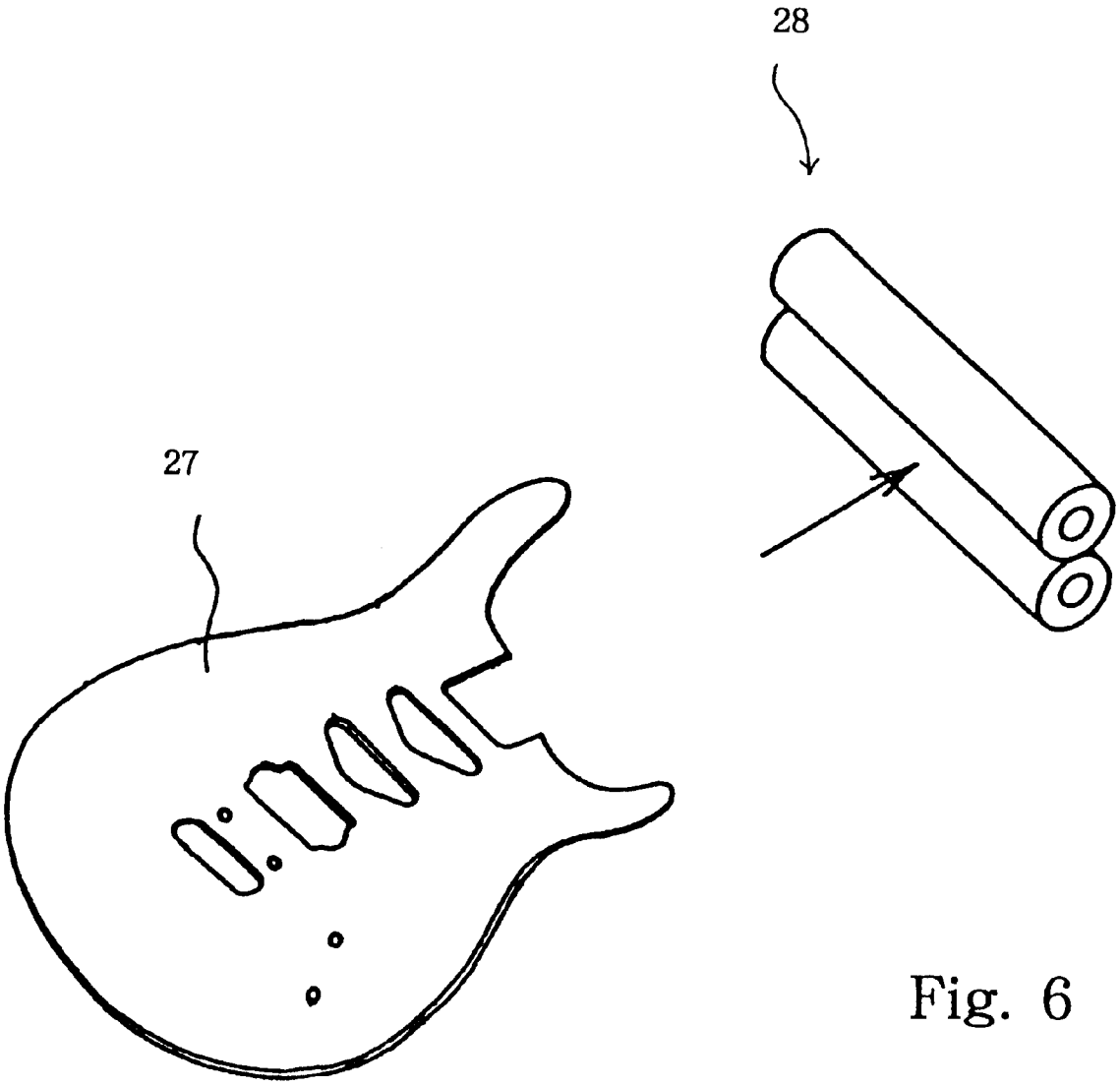
FIG. 6 is a perspective view showing a wood work to be polished by a polishing machine.

If the manufacturer selects a veneer board, veneer boards are shaped into the front deck plate 22 and the back deck plate 23 by using a CNC (Computer Numerical Control) router machine or a template, and the wood works are painted and polished. FIG. 6 illustrates the wood work 22 to be polished by a polishing machine 28. The wood works may be painted by using a roll coater (not shown), and the polishing machine may be an automatic polisher or a buff machine. Even if the front deck plate 22 and the back deck plate 23 are formed of wood, the wood works are flat, and are simpler than the solid wooden body. For this reason, the painting steps are easier than those for the solid wooden body are, and the manufacturer enhances the productivity of the body 20.

Upon completion of the painting/polishing steps, the painted wood works are deformed, and are shaped into the front deck plate 22 and the back deck plate 23. The front deck plate 22 and the back deck plate 23 are adhered to the body frame 21 and the center block 24.

As will be appreciated from the foregoing description, the body frame 22 is formed of metal/alloy or synthetic resin, and the metal/alloy and the synthetic resin are available for other parts, i.e., the center block 24, the front deck plate 22 and the back deck plate 23. The metal, the alloy and the synthetic resin are abundant, and are not costly. Neither painting step nor polishing step is required for the body frame 22, and the fabrication process is simple. The body frame 22 serves as a side panel, and allows the manufacturer to delete the side panel from the structure. Thus, the body 20 makes the manufacturer reduce the production cost of the stringed musical instrument.

Metal or alloy is shaped into the body frame 22 through a casting, and synthetic resin is shaped into the body frame 22 through a molding. Using the casting/molding, the manufacturer can freely give a novel design to the body 20, and makes the stringed musical instrument attractive to users.

The body frame 22 imparts a unique tone color to the electric sounds. The metal and the alloy are recycled, and are desirable from the viewpoint of the conservation of resources.

When the body frame 22 is formed of aluminum alloy or magnesium alloy, the electric guitar is light, and the body 20 formed of the conductive material is enhanced in anti-noise property. On the other hand, if the synthetic resin is used, the manufacturer arbitrarily colors the body 20. The front deck plate 22 and the back deck plate 23 both formed from the veneer boards make the stringed musical instrument a higher grade.

Although the particular embodiment of the present invention has been shown and described, it will be apparent to those skilled in the art that various changes and modifications may be made without departing from the spirit and scope of the present invention.

Various contours may be given to the body frame 21 and, accordingly, the front/back deck plates 22/23.

The body frame 21 may be integral with the center block 24. If so, both of the body frame 21 is identical in material with the center block 24, and the fabrication process is further simplified.

The present invention is applicable to any kind of stringed musical instrument such as, for example, an acoustic stringed musical instrument and another kind of electric stringed musical instrument.

What is claimed is:

1. A stringed musical instrument comprising:

a body including a body frame formed of a first material selected from the group consisting of metal, alloy and synthetic resin and having a peripheral wall defining a hollow space therein and partition walls provided in said hollow space and connected to said peripheral wall so as to define an inner space therebetween open to a front surface and a back surface thereof, a center block formed of a second material and accommodated in said inner space and deck plates formed of a third material and fixed to said front surface and said back surface so as to confine said center block in said inner space, and at least one string stretched over said front deck plate.

2. The stringed musical instrument as set forth in claim 1, in which said alloy is selected from the group consisting of aluminum alloy and magnesium alloy.

3. The stringed musical instrument as set forth in claim 1, further comprising a vibration detecting unit provided on one of said deck plates under said at least one string so as to produce an electric signal representative of vibrations of said at least one string.

4. The stringed musical instrument as set forth in claim 3, in which said first material is electrically conductive.

5. The stringed musical instrument as set forth in claim 4, in which said first material is synthetic resin containing conductive particles.

6. The stringed musical instrument as set forth in claim 1, in which said alloy is selected from the group consisting of aluminum alloy and magnesium alloy.

7. The stringed musical instrument as set forth in claim 1, in which said first material is colored synthetic resin.

8. The stringed musical instrument as set forth in claim 1, in which said second material is selected from the group consisting of metal, alloy, synthetic resin and wood.

9. The stringed musical instrument as set forth in claim 8, in which said first material is identical with said second material.

10. The stringed musical instrument as set forth in claim 9, in which said body frame is integral with said center block.

11. The stringed musical instrument as set forth in claim 1, in which said third material is selected from the group consisting of metal, alloy, synthetic resin, wood and composite material.

12. The stringed musical instrument as set forth in claim 11, in which said wood is formed into a veneer board.

13. The stringed musical instrument as set forth in claim 1, in which said third material is synthetic resin.

14. The stringed musical instrument as set forth in claim 13, in which said synthetic resin is colored.

* * * * *